United States Patent [19]

Sagnes

[11] Patent Number: 4,747,749

[45] Date of Patent: May 31, 1988

[54] MACHINE FOR COMPRESSING A FLUID, HAVING A PLURALITY OF COMPRESSION STAGES IN SERIES

[75] Inventor: Pierre F. J. Sagnes, Rambouillet, France

[73] Assignee: Bertin & Cie., Plaisir, France

[21] Appl. No.: 39,280

[22] Filed: Apr. 17, 1987

Related U.S. Application Data

[63] Continuation of Ser. No. 659,970, Oct. 11, 1984, abandoned.

[30] Foreign Application Priority Data

Oct. 25, 1983 [FR] France ..... 83 17000

[51] Int. Cl.[4] ..... F01D 13/00

[52] U.S. Cl. ..... 415/143

[58] Field of Search ..... 415/143, 106, 107, 116, 415/198.2, 198.1

[56] References Cited

U.S. PATENT DOCUMENTS

| | | | |
|---|---|---|---|
| 1,601,402 | 9/1926 | Lorenzen | 415/143 |
| 2,748,714 | 6/1956 | Henry | 415/104 |
| 3,385,225 | 5/1968 | Hagemann | 415/143 |
| 4,390,317 | 6/1983 | Lehmann et al. | 415/143 |
| 4,431,371 | 2/1984 | Thomson | 415/116 |

FOREIGN PATENT DOCUMENTS

| | | | |
|---|---|---|---|
| 513423 | 10/1952 | Belgium | 415/143 |
| 711791 | 9/1941 | Fed. Rep. of Germany | 415/143 |
| 9107 | 1/1977 | Japan | 415/143 |
| 168091 | 10/1982 | Japan | 415/106 |
| 612072 | 6/1978 | U.S.S.R. | 415/53 T |

*Primary Examiner*—Edward K. Look
*Assistant Examiner*—John T. Kwon
*Attorney, Agent, or Firm*—Dennison, Meserole, Pollack & Scheiner

[57] ABSTRACT

The machine comprises a plurality of series-connected compression stages, incorporating at least two different types of compressor. The inlet stages of the machine are constituted by centrifugal compressors (C1, C2) and the outlet stages are constituted by peripheral compressors ($P_{n-1}$, $P_n$), with the compressors being driven by a single drive shaft (30) and being lodged in a single housing (24, 26, 28). The machine is particularly intended for delivering a few hundreds to several tens of thousands of $m^3$ of carbon dioxide gas per hour at a pressure of about 150 bars to about 300 bars.

16 Claims, 1 Drawing Sheet

MACHINE FOR COMPRESSING A FLUID, HAVING A PLURALITY OF COMPRESSION STAGES IN SERIES

This is a continuation of co-pending application Ser. No. 659,970 filed on Oct. 11, 1984, now abandoned.

The present invention relates to a machine for compressing a fluid and comprising a plurality of different types of compressor stage in series.

BACKGROUND OF THE INVENTION

When there is a need to supply fluid flow rates to a few hundred to a several tens of thousands of $m^3$ per hour and at a pressure lying in a range from about 100–150 bars to about 300–350 bars, one known technique consists in associating centrifugal compressors with alternating piston compressors or with screw compressors, such that the fluid is initially compressed by the centrifugal compressors, and is subsequently compressed by the piston or screw compressors.

Such a compressor set may, in particular, produce compressed gas for injection into an oil well (on- or off-shore) for the purpose of assisted oil recovery. This known method of exploiting an oil field is characterized, inter alia, by the need to reduce the rate of gas flow as the oil is extracted. This flow rate reduction constitutes a major drawback when the compressed gas is supplied by a set of centrifugal compressors together with piston or screw compressors, since there is then a risk of reaching the "pumping limit" below which very large pressure oscillations occur together with vibrations that are capable of destroying the compressors.

This risk can be avoided by increasing the number of centrifugal compressor stages, but only at the cost of corresponding increases in capital expenditure, and in maintenance and running costs.

Further, the piston or screw compressors which are associated with the centrifugal compressors have drawbacks of their own; they are expensive and bulky, they require frequent and expensive maintenance, and they vibrate and are noisy in operation. It is also necessary to provide step-down gearing so that they can be driven from the same motors that drive the centrifugal compressors.

Preferred embodiments of the present invention provide machines for compressing a fluid and capable of operating in the above-mentioned range of flow rates and pressure, but which avoid or greatly reduce the above-mentioned drawbacks of the prior art.

Such preferred machines are compact, monoblock device that take up little space.

Such preferred machines are additionally much more reliable than prior art machines of equivalent performance.

SUMMARY OF THE INVENTION

The present invention provides a machine for compressing a fluid, the machine being intended in particular for delivering a fluid flow rate of a few hundred to several tens of thousands of $m^3$ per hour at a pressure lying in the range of about 150 bars to about 300 bars, and comprising a plurality of different types of compressor stage in series, the improvement wherein at least one centrifugal compressor constituting an inlet stage to the machine is associated with at least one peripheral stage constituting an outlet stage from the machine.

The association of peripheral compressors (which may also be known to the person skilled in the art as impulse compressors, recuperation compressors, or friction compressors) with centrifugal compressors makes it possible to obtain a machine which is particularly compact, in which the peripheral compressor rotors are of much the same diameter as the centrifugal compressor rotors and are capable of being driven at the same speed of rotation as the centrifugal compressor rotors, thereby enabling all of the compressors to be mounted on a single drive shaft.

The use of step-down gearing is thus avoided.

In addition, peripheral compressors do not present pumping phenomena when the fluid flow rate is reduced and are capable of obtaining manometer powers which are several times higher than those of centrifugal compressors.

Thus, for a given number of centrifugal compressors, the centrifugal compressors in a machine in accordance with the invention may be more lightly loaded than those in equivalent prior art machines, thereby making them less subject to pumping phenomena.

Furthermore, centrifugal compressors and peripheral compressors mounted on a common drive shaft may be received in a common housing, thereby reducing the minimum possible number of sealed rotary bearings for the drive shaft to just one, with the other end of the drive shaft being received in a thrust bearing located in a blind recess at the other end of the housing.

Advantageously, the drive shaft for the centrifugal and peripheral compressors is directly coupled to an appropriate motor, e.g. a gas turbine.

A machine in accordance with the invention may thus associate all the centrifugal and peripheral compressors required for compressing the fluid within a single housing and on a single drive shaft which is directly coupled to drive means.

BRIEF DESCRIPTION OF THE DRAWINGS

An embodiment of the invention is described by way of example with reference to the accompanying drawings, in which.

MORE DETAILED DESCRIPTION

Figure 1:
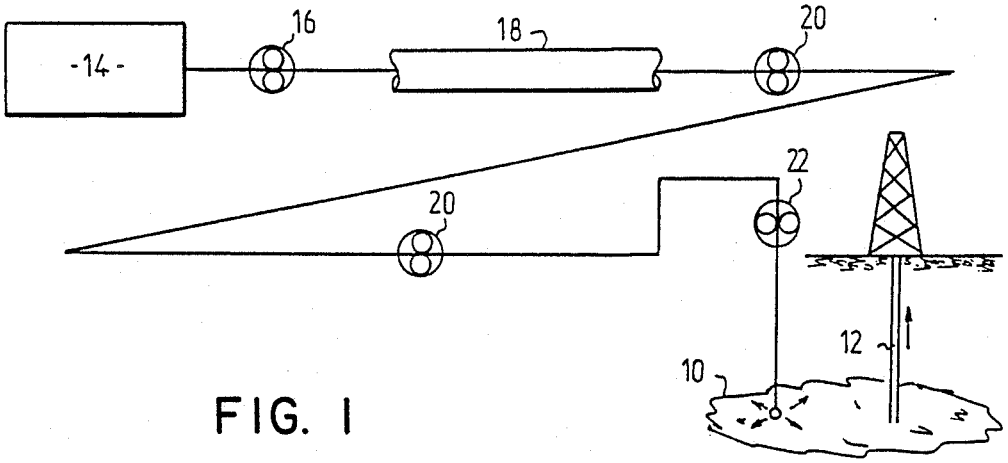
FIG. 1 is a diagram illustrating the application of the invention to recovering oil.

Reference is made initially to FIG. 1 which shows, by way of example, a particularly effective application of the invention to a method of assisted oil recovery.

This method, which is known in the art, consists in injecting a gas, e.g. carbon dioxide, under pressure into an oil field 10 (which oil field may be on- or off-shore), in order to assist the rise of oil to the surface through a production well or conduit 12.

The gas e.g. carbon dioxide used is obtained from an appropriate source 14, e.g. a burner unit fed from a natural gas field, or a factory for synthesizing urea, etc. The carbon dioxide supplied by the source 14 is at a pressure which lies, for example, in the range 1 to 20 bars. This pressure may be increased to 150 bars by a compressor station 16 feeding a pipeline 18 for conveying the compressed gas to the oil field. Recompression stations 20 are provided along the pipeline 18 to make up for head losses, e.g. for raising the carbon dioxide pressure from 80 bars back to about 150 bars. A final compressor station 22 raises the carbon dioxide pressure from 80 bars to about 250 to 300 bars for injection into the oil field 10.

The corresponding flow rates of carbon dioxide gases are typically from a few hundred to several thousand metric tons (tonnes) per day, and the rate at which carbon dioxide gas should be injected into the oil field falls off progressively as the oil is extracted therefrom. Compressor machines in accordance with the invention (e.g. the one shown diagrammatically in FIG. 2) are specifically intended for use in the pumping stations 16, 20 and 22.

Figure 2:
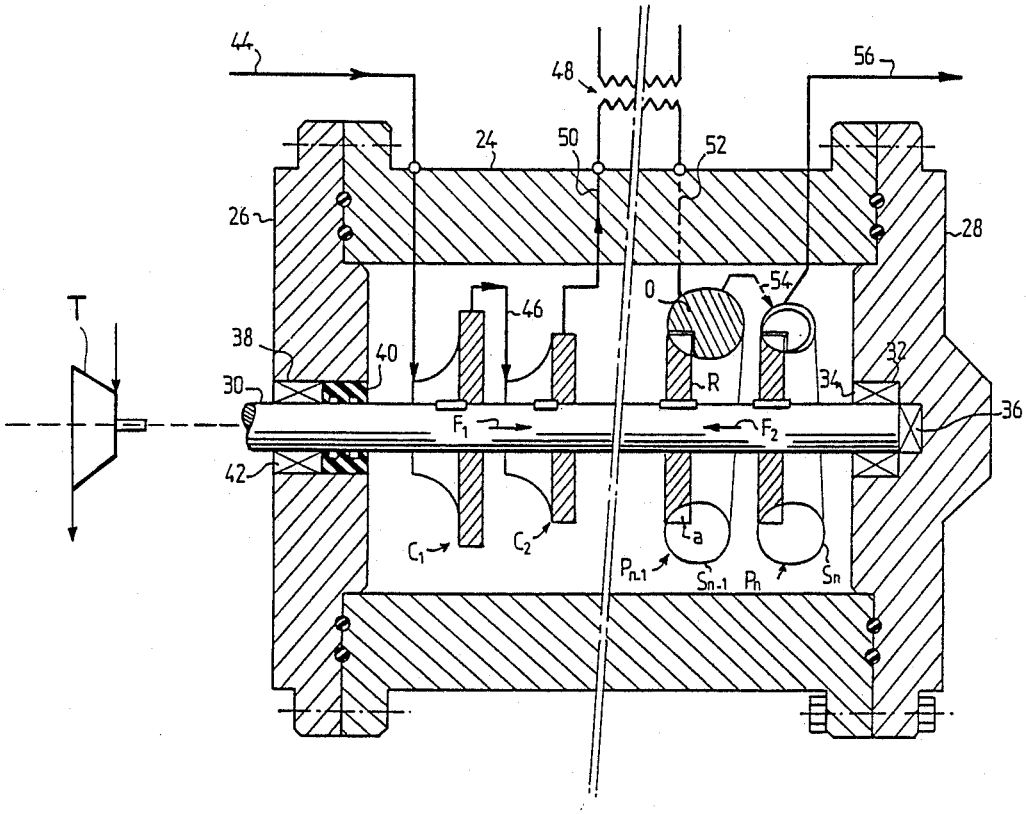
FIG. 2 is a diagrammatic axial section through a machine in accordance with the invention.

The machine shown in FIG. 2 comprises a single housing constituted by a hollow cylindrical body 24 and two end plates 26 and 28 sealed to the ends of the body 24. A drive shaft 30 extends axially along the body 24 and is received at his end in a blind recess 32 in the end plate 28 by means of a rotary bearing 34 and an axial thrust bearing 36. The other end of the shaft 30 passes through a cylindrical passage 38 in the end plate 26. The passage is sealed by sealing rings 40 and the shaft is supported by rotary bearings 42. The end of the shaft 30 outside the housing is driven by direct coupling to an appropriate motor, e.g. a gas turbine.

Centrifugal compressor rotors C1, C2, . . . are fixed on the shaft 30 inside the housing 24, thereby constituting the inlet stages of the machine. Peripheral compressor rotors $P_{n-1}$, $P_n$, are likewise fixed on the shaft 30 inside the housing 24 thereby constituting outlet stages of the machine which comprises a total of n compressor stages in series.

The stators (not shown) of the centrifugal compressors C1, C2, . . . and the stators $S_{n-1}$, $S_n$ of the peripheral compressors are contained inside the body 24 of the housing and are directly supported thereby.

A gas inlet conduit 44 passes through the body 24 in sealed manner and delivers gas to the inlet of the first centrifugal compressor C1. The outlet from the first compressor C1 is connected, inside the body 24, to the inlet of the second centrifugal compressor C2, as indicated diagrammatically at 46, and so on. Each time it may become necessary, e.g. each time the temperature of the compressed gas reaches 200° C., the compressed gas may be cooled by passing it through a heat exchanger 48 located outside the machine housing. To do this, the exchanger 48 is connected, through the wall of the body 24, to the outlet from one compressor and to the inlet to the next compressor, as indicated diagrammatically at 50 and 52 in the figure.

It can also be seen that the outlet from the peripheral compressor $P_{n-1}$ is connected to the inlet to the peripheral compressor $P_n$ as indicated diagrammatically at 54, and that the outlet from the compressor $P_n$ which constitutes the last compression stage of the machine, is connected in sealed manner through the wall of the body 24 to an outlet conduit 56 from the machine as whole.

The structure of a centrifugal compressor is well known in the art and need not be given in greater detail here. It is merely recalled that a peripheral compressor (also known as a recuperation compressor) comprises a rotor R having blades a rotating in an annular compression chamber formed by the compressor stator. The annular compression chamber has a sealing plug O fixed therein, with the plug including a closely-fitting notch through which the rotor blades a pass. The fluid inlet and outlet conduits open out into the annular compression chamber on respective sides of the sealing plug O.

Advantageously, the centrifugal and the peripheral compressors are mounted on the drive shaft 30 in such a manner that the axial thrust F1 developed by the centrifugal compressors opposes the axial thrust F2 developed by the peripheral compressors, thereby at least reducing, if not cancelling, the net axial thrust exerted by the shaft 30 on the end plate 28 of the housing.

The above description of the structure of the machine renders its operation obvious.

The centrifugal and peripheral compressor rotors C1, C2, . . . , $P_{n-1}$, $P_n$ are driven at the same speed of rotation by the common drive shaft 30, which is itself driven by a direct coupling to a gas turbine T or analogous motor. The fluid to be compressed is inserted into the machine via the conduit 44 which passes through the wall of the housing 24. The fluid is compressed in steps as it passes through the various stages of centrifugal and then peripheral compression, and leaves the machine at an outlet pressure lying in the range from about 150 bars to about 300 bars.

The heat exchangers 48 cool the compressed gas each time cooling is necessary between two successive compression stages.

Machines in accordance with the invention are intended in particular for compressing gas at flow rates in the range of a few hundred to several thousand tonnes per day, which rates are likely to drop off progressively over time. The use of peripheral compressors as the outlet stages of the machine makes it possible firstly to reduce the sensitivity of the centrifugal inlet stages of the machine to pumping phenomena, and secondly to associate all the compressor stages on a common shaft inside a common housing. This last feature stems from the fact that the peripheral compressors can be designed to run at the same speed of rotation as the centrifugal compressors.

The invention is also applicable to delivering liquid under pressure, e.g. by compressing a gas in the centrifugal compressors, by liquefying the gas in a heat exchanger external to the machine and then by compressing the liquid in the peripheral compressors.

By way of numerical example, a machine in accordance with the invention and suitable for the last pumping station 22 prior to injecting compressed carbon dioxide gas into the oil field 10 is associated with a gas turbine delivering a few megawatts of power and driving the shaft 30 at a speed of 10,000 to 12,000 revolutions per minute (rpm), the shaft 30 being 200 mm in diameter and the centrifugal and peripheral compressors being 400 to 500 mm in diameter. The machine may be supplied with carbon dioxide gas at 1000 to 800 tonnes per day and at an inlet pressure of about 80 bars, and it may deliver the gas at an outlet pressure of about 250 to 300 bars.

Depending on availability and price, a gas other than carbon dioxide e.g. nitrogen may be used to propel the carbon dioxide.

I claim:

1. In a system for compressing a gas, for delivering a gas flow rate of a few hundred to several tens of thousands of $m^3$ per hour at a pressure lying in the range of about 150 bars to about 300 bars, and comprising a source of gas, a plurality of different types of compressor stages in series, and a connection between said source of gas and the first of said series of compressor stages, the improvement wherein at least one centrifugal compressor constituting an inlet stage to the series is associated with at least one peripheral compressor constituting an outlet stage from the series, said peripheral compressor including at least one rotor with an inlet and outlet at the periphery thereof, whereby a reduction in the flow rate of the gas does not result in vibrations capable of destroying the compressor stages.

2. A system according to claim 1, wherein the drive shaft is directly coupled to a drive means via an output shaft of said drive means.

3. A system according to claim 2, wherein said drive means is a gas turbine.

4. A system according to claim 1, wherein the compressors constituting the various compression stages of the machine are driven by a common shaft at the same speed.

5. A system according to claim 4, wherein the compressors are mounted on the said shaft in such a manner that the axial thrust developed by the centrifugal compressors is opposed to the axial thrust developed by the peripheral compressors.

6. A system according to claim 4, wherein the compressors are lodged in a common housing.

7. A system according to claim 6, wherein one end of the drive shaft is received by means of a thrust bearing in a blind recess in an end wall of the housing.

8. A system according to claim 6, wherein heat exchanger means are provided outside the said housing for cooling the compressed fluid at least between one adjacent pair of compression stages.

9. A system according to claim 1, wherein the fluid for compression is carbon dioxide gas.

10. A system according to claim 1, wherein said outlet stage is connected to an underground or offshore oil field, whereby compressed gas is injected into the oil field for assisted oil recovery.

11. A method for compressing a gas for delivering a flow rate of a few hundred to several tens of thousands of $m^3$ per hour at a pressure lying in the range of about 150 bars to about 300 bars, comprising supplying said gas to a plurality of different types of compressor stages in series including an initial stage which comprises at least one centrifugal compressor, and a final stage which comprises at least one peripheral compressor including at least one section with an inlet and an outlet at the periphery thereof.

12. A method according to claim 11, wherein said compression stages are driven at the same speed by a common shaft.

13. A method according to claim 12, wherein the compressors are mounted on said shaft in such a manner that the axial thrust developed by the centrifugal compressors is opposed to the axial thrust developed by the peripheral compressors.

14. A method according to claim 12, wherein said drive shaft is driven by a drive means through an output shaft of said drive means.

15. A method according to claim 11, additionally comprising cooling said compressed gas between at least one adjacent pair of compression stages.

16. A method according to claim 11, wherein said gas is carbon dioxide.

* * * * *